US006247523B1

(12) United States Patent
Shibagaki et al.

(10) Patent No.: US 6,247,523 B1
(45) Date of Patent: Jun. 19, 2001

(54) EXHAUST GAS HEAT EXCHANGER

(75) Inventors: Kazuhiro Shibagaki, Kariya; Takaki Okochi, Chiryu; Katsunori Uchimura, Takahama; Shigeki Daidou, Nishio, all of (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 09/626,359

(22) Filed: Jul. 27, 2000

(30) Foreign Application Priority Data

Jul. 30, 1999 (JP) ..... 11-217896
Jul. 30, 1999 (JP) ..... 11-217897

(51) Int. Cl.[7] ..... F28F 3/12
(52) U.S. Cl. ..... 165/51; 165/153; 165/166
(58) Field of Search ..... 165/51, 158, 157, 165/907, 160, 162, 170, 166, 153, 167; 123/568.12; 60/618, 514

(56) References Cited

U.S. PATENT DOCUMENTS

| | | | | |
|---|---|---|---|---|
| 3,768,149 | | 10/1973 | Swaney, Jr. . | |
| 3,962,869 | * | 6/1976 | Wossner | 60/298 |
| 4,107,922 | * | 8/1978 | Wossner | 60/298 |
| 4,215,742 | * | 8/1980 | Weed | 165/51 |
| 4,605,060 | * | 8/1986 | Andersson et al. | 165/166 |
| 5,307,870 | | 5/1994 | Kamiya et al. . | |
| 5,803,162 | * | 9/1998 | Karbach et al. | 165/166 |
| 5,915,472 | * | 6/1999 | Takikawa et al. | 165/158 |
| 5,931,219 | * | 8/1999 | Kull et al. | 165/51 |
| 5,983,992 | * | 11/1999 | Child et al. | 165/153 |
| 6,161,528 | * | 12/2000 | Akao et al. | 123/568.12 |

FOREIGN PATENT DOCUMENTS

| | | |
|---|---|---|
| 0 811 762 | 12/1997 | (EP) . |
| 58-217182 | 12/1983 | (JP) . |

OTHER PUBLICATIONS

Patent Abstracts of Japan, vol. 2000, No. 02, Feb. 29, 2000 & JP 11–303689.

* cited by examiner

*Primary Examiner*—Ira S. Lazarus
*Assistant Examiner*—Terrell McKinnon
(74) *Attorney, Agent, or Firm*—Harness, Dickey & Pierce, PLC

(57) ABSTRACT

An exhaust gas heat exchanger includes exhaust gas tubes through which exhaust gas generated by a combustion flows and cooling water tubes through which cooling water for cooling exhaust gas flows. Plural segments of offset fins are disposed within each exhaust gas tube to be arranged staggeringly in a tube longitudinal direction. The cooling water tubes communicate with each other through cooling water communication passages disposed on both end sides of each exhaust gas tube in the tube longitudinal direction at diagonal positions when being viewed from a minor-diameter direction of each exhaust gas tube. The segments are tilted relative to the tube longitudinal direction toward a side opposite to a diagonal line (L1) connecting the cooling water communication passages. Thus, a cross angle between the tilt direction of the segments and a main flow of the exhaust gas becomes smaller, and a pressure loss in the exhaust gas tubes is reduced.

10 Claims, 13 Drawing Sheets

EXHAUST GAS HEAT EXCHANGER

CROSS-REFERENCE TO RELATED APPLICATION

This application is related to and claims priority from Japanese Patent Applications No. Hei. 11-217896 filed on Jul. 30, 1999, and No. Hei. 11-217897 filed on Jul. 30, 1999, the contents of which are hereby incorporated by reference.

BACKGROUND OF THE INVENTION

1. Field of the Invention

The present invention relates to an arrangement structure of segments of offset fins in an exhaust gas heat exchanger for performing a heat exchange between exhaust gas generated by a combustion and a cooling fluid such as cooling water. The present invention is suitably applied to an EGR cooler for cooling exhaust gas in an exhaust gas recirculation system (i.e., EGR system).

2. Description of Related Art

For effectively reducing nitrogen oxide contained in exhaust gas generated by a combustion, exhaust gas used for an exhaust gas recirculation (hereinafter, referred to as "EGR") is cooled by an EGR cooler. However, when a heat exchanger having inner fins within a tube is simply applied to the EGR cooler, heat-exchanging capacity of the EGR cooler is difficult to be increased, because dust such as carbon is contained in the exhaust gas and is readily collected within tube, for example.

SUMMARY OF THE INVENTION

In view of the foregoing problems, it is an object of the present invention to provide an exhaust gas heat exchanger which prevents pressure loss within an exhaust gas tube from being increased and dust contained in exhaust gas from being collecting within the exhaust gas tube.

It is an another object of the present invention to provide an exhaust gas heat exchanger which improves heat-transmitting percentage of offset fins disposed within an exhaust gas tube, while it can prevent pressure loss within the exhaust gas tube from being increased and dust contained in exhaust gas from being collecting within the exhaust gas tube.

According to the present invention, an exhaust gas heat exchanger includes an exhaust gas tube through which exhaust gas generated by a combustion flows, a plurality of cooling fluid tubes through which cooling fluid for cooling exhaust gas flows, and an offset fin disposed within the exhaust gas tube. The cooling fluid tubes are disposed adjacent to both ends of the exhaust gas tube in a minor-diameter direction of the exhaust gas tube, and the offset fin has a plurality of plate-like segments which are approximately parallel to the minor-diameter direction and are arranged staggeringly in a longitudinal direction of the exhaust gas tube. In the exhaust gas heat exchanger, the segments are disposed to be tilted in a tilt direction relative to the longitudinal direction. Thus, it is possible to readily arrange the segments in accordance with a structure of the exhaust gas heat exchanger.

Preferably, cooling fluid communication passages through which the cooling fluid tubes communicate with each other are disposed on both end sides of the exhaust gas tube in the longitudinal direction at diagonal positions when being viewed from the minor-diameter direction, and the segments are disposed to be tilted relative to the longitudinal direction toward a side opposite to a diagonal line (L1) connecting the cooling fluid communication passages. Therefore, a cross angle between the tilt direction of the segments and a main flow of exhaust gas becomes smaller, and pressure loss, generated while exhaust gas flows through the exhaust gas tube, can be reduced. Accordingly, an exhaust gas amount flowing through the exhaust gas tube can be increased, and heat-exchanging capacity of the exhaust gas heat exchanger is increased. Further, even when the cross angle between the tilt direction of the segments and the main flow of exhaust gas becomes smaller, a flow of exhaust gas directly colliding with plate surfaces of the segments and a flow of exhaust gas crossing the segments at different tilt lines are generated. Therefore, dust adhered on the segments is removed, and flows forcedly at a downstream side. Thus, it can prevent dust from being collected in the offset fin within the exhaust gas tube.

Preferably, when an arrangement of the segments from one end to the other end of the exhaust gas tube in a major-diameter direction is indicated as a row, and when an arrangement of the segments from one end to the other end of the exhaust gas tube in the longitudinal direction is indicated as a line, a segment positioned at i-line and j-row is tilted toward a center of any one segment except for i-line segments, j-row segments and (i+n)-line and (j+n)-row positioned segments. Therefore, a distance between adjacent segments on the same tilt line in the tilt direction of the segments becomes larger, and it can prevent a temperature boundary layer from being generated over an entire area in the longitudinal direction of the exhaust gas tube. Thus, heat-transmitting percentage between the offset fins and exhaust gas can be improved, and heat-exchanging capacity of the exhaust gas heat exchanger is increased. In this case, when the segments are disposed to be tilted relative to the longitudinal direction toward the side opposite to the diagonal line (L1), the exhaust gas heat exchanger improves heat-transmitting percentage of the offset fin while preventing the pressure loss within the exhaust gas tube from being increased.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PREFERRED EMBODIMENTS

Figure 1:
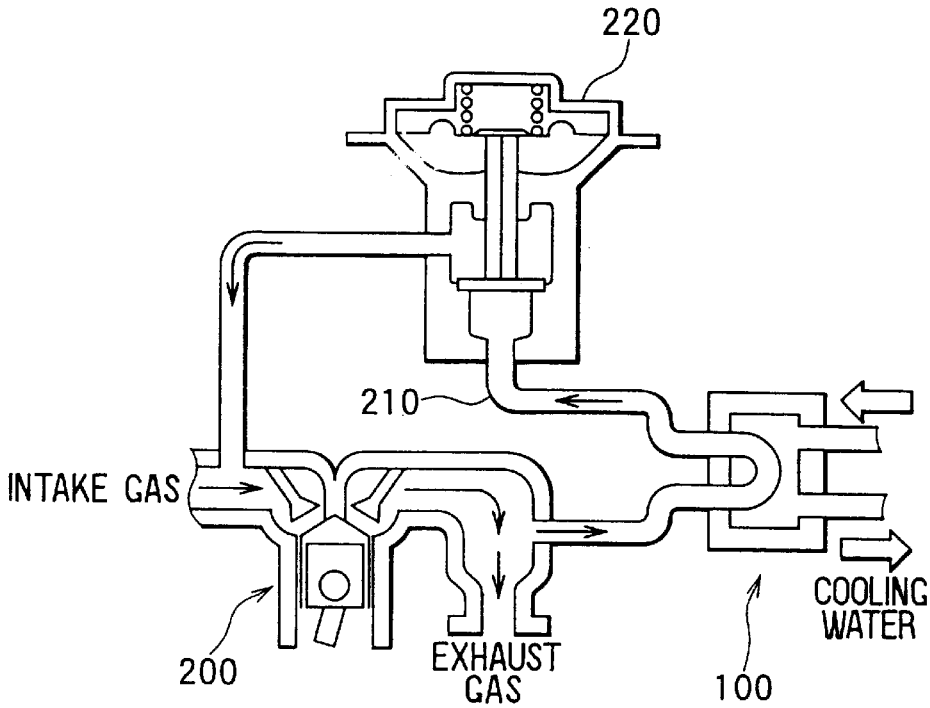
FIG. 1 is a schematic view of an EGR system according to a first preferred embodiment of the present invention.
Figure 2:
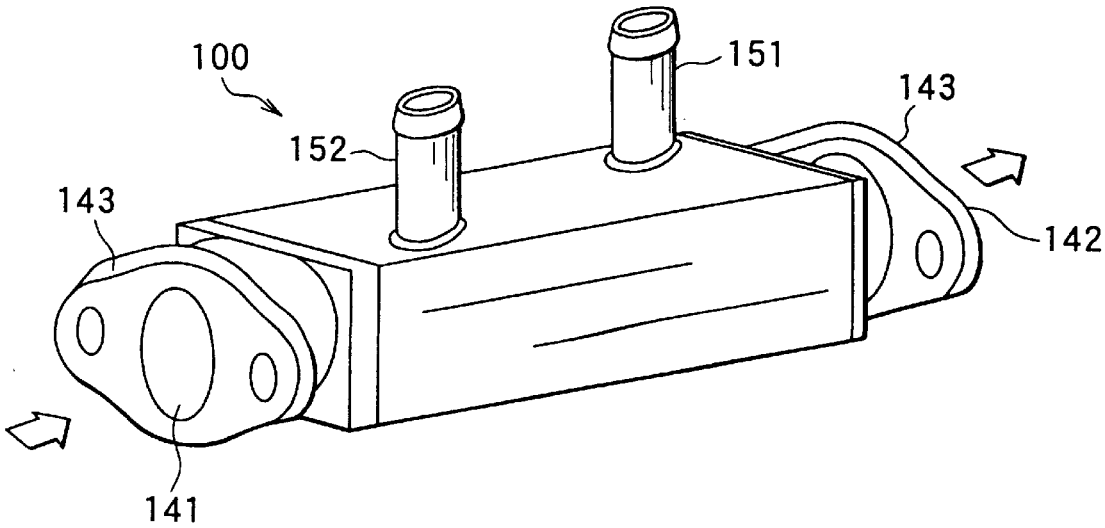
FIG. 2 is a perspective view of an EGR cooler used for the EGR system according to the first embodiment.
Figure 3:
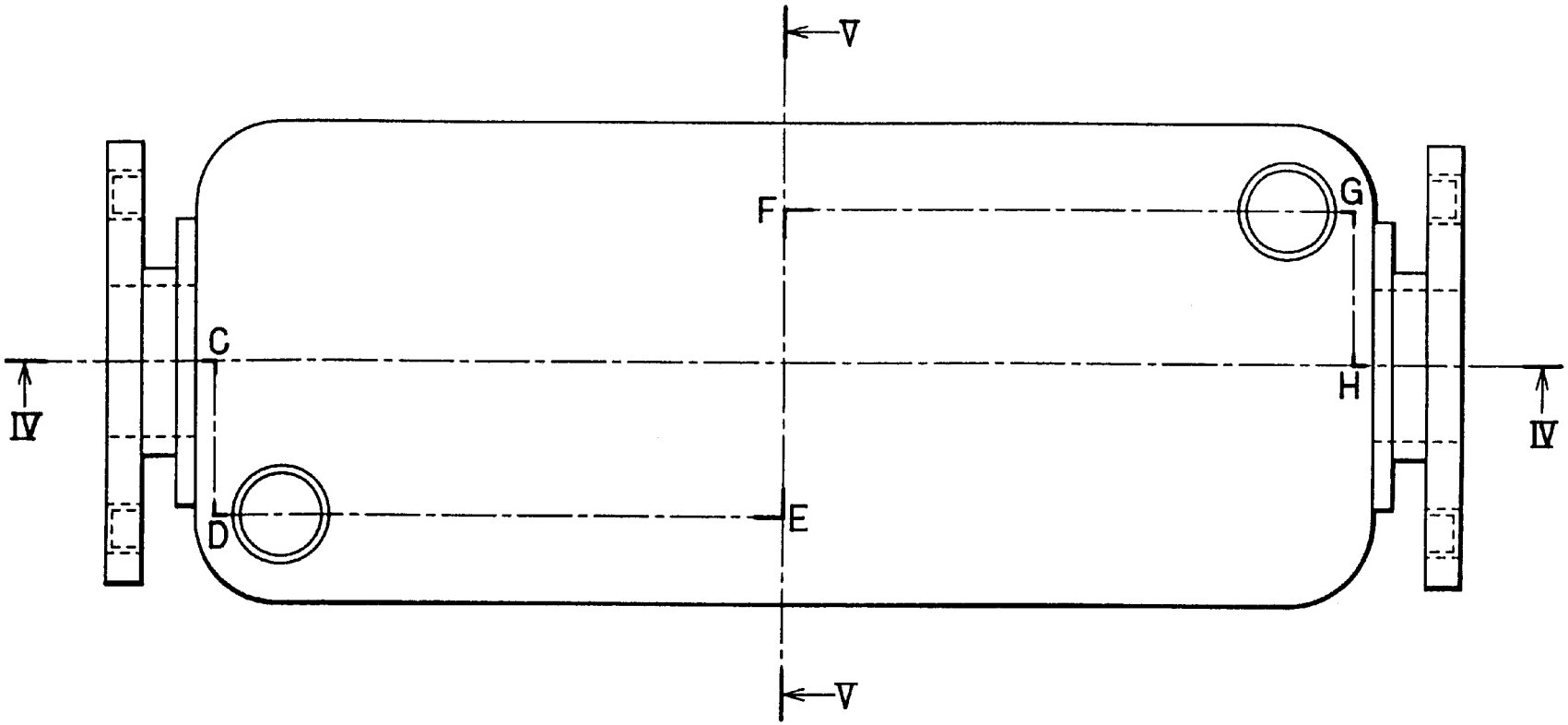
FIG. 3 is a top view of the EGR cooler according to the first embodiment.

Preferred embodiments of the present invention will be described hereinafter with reference to the accompanying drawings.

A first preferred embodiment of the present invention will be now described with reference to FIGS. 1–11. In the first embodiment, the present invention is typically applied to an EGR cooler 100 of an exhaust gas recirculation system (EGR system) for a diesel internal combustion engine 200.

The EGR system includes an exhaust gas recirculation pipe 210 through which a part of exhaust gas discharged from the engine 200 returns to an intake side of the engine 200. An EGR valve 220 for adjusting an exhaust gas recirculation amount in accordance with an operation state of the engine 200 is disposed in the exhaust gas recirculation pipe 210. The EGR cooler 100 is disposed between an exhaust gas side of the engine 200 and the EGR valve 220 so that a heat exchange is performed between exhaust gas discharged from the diesel engine 200 and cooling water (i.e., engine-cooling water).

Next, structure of the EGR cooler 100 will be described in detail. As shown in FIGS. 2–6, the EGR cooler 100 includes a core portion, a joint having an exhaust gas introduction port 141 and an exhaust gas discharge port 142, a water inlet pipe 151 for introducing cooling water, and a water outlet pipe 152 for discharging cooling water having been heat-exchanged with exhaust gas.

Figure 5:
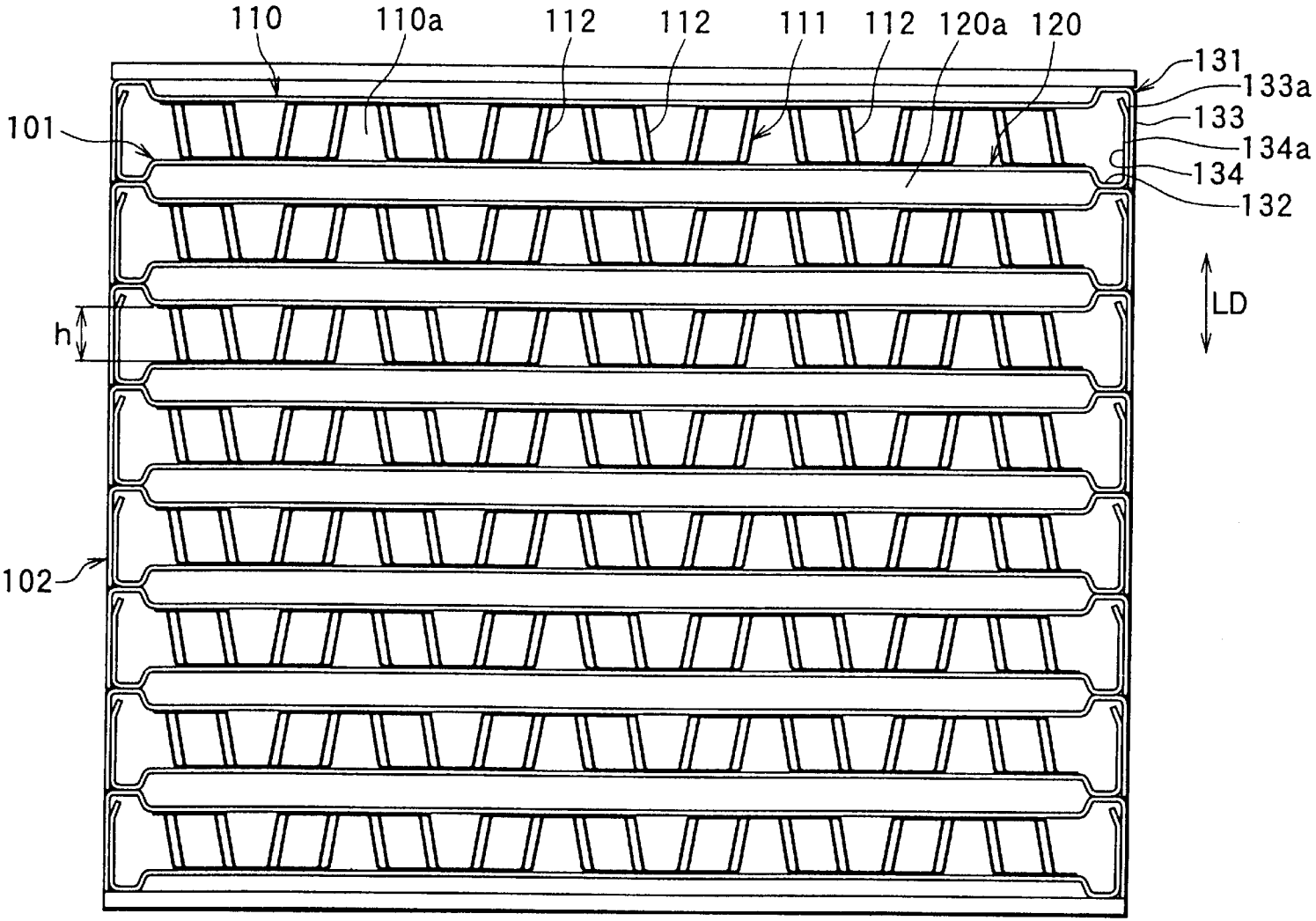
FIG. 5 is a cross-sectional view taken along line V—V in FIG. 3.

As shown in FIG. 5, the core portion of the EGR cooler 100 includes plural rectangular flat exhaust gas tubes 110 for defining exhaust gas passages 110*a*, and plural rectangular flat cooling water tubes 120 for defining cooling water passages 120*a*. Both the tubes 110, 120 are alternately laminated adjacent to each other in a tube minor-diameter direction (i.e., the up-down direction in FIG. 5). Stainless inner fins 111 for increasing contact areas with exhaust gas are disposed in the exhaust gas passages 110*a*, so that a heat exchange between exhaust gas and cooling water is facilitated. The inner fins 111 are offset fins in which plate-like segments 112 approximately parallel to the minor-diameter direction of the exhaust gas tubes 110 are arranged in a longitudinal direction of the exhaust gas tubes 110 to be offset staggeringly. The offset fins are defined in the heat exchanger design handbook (published in Japan by the engineering science book, Inc.), for example. The segments 112 of the inner fins 111 are slightly tilted relative to the tube minor-diameter direction by the draft of a roller or a press-forming machine when the inner fins are manufactured.

Figure 4:
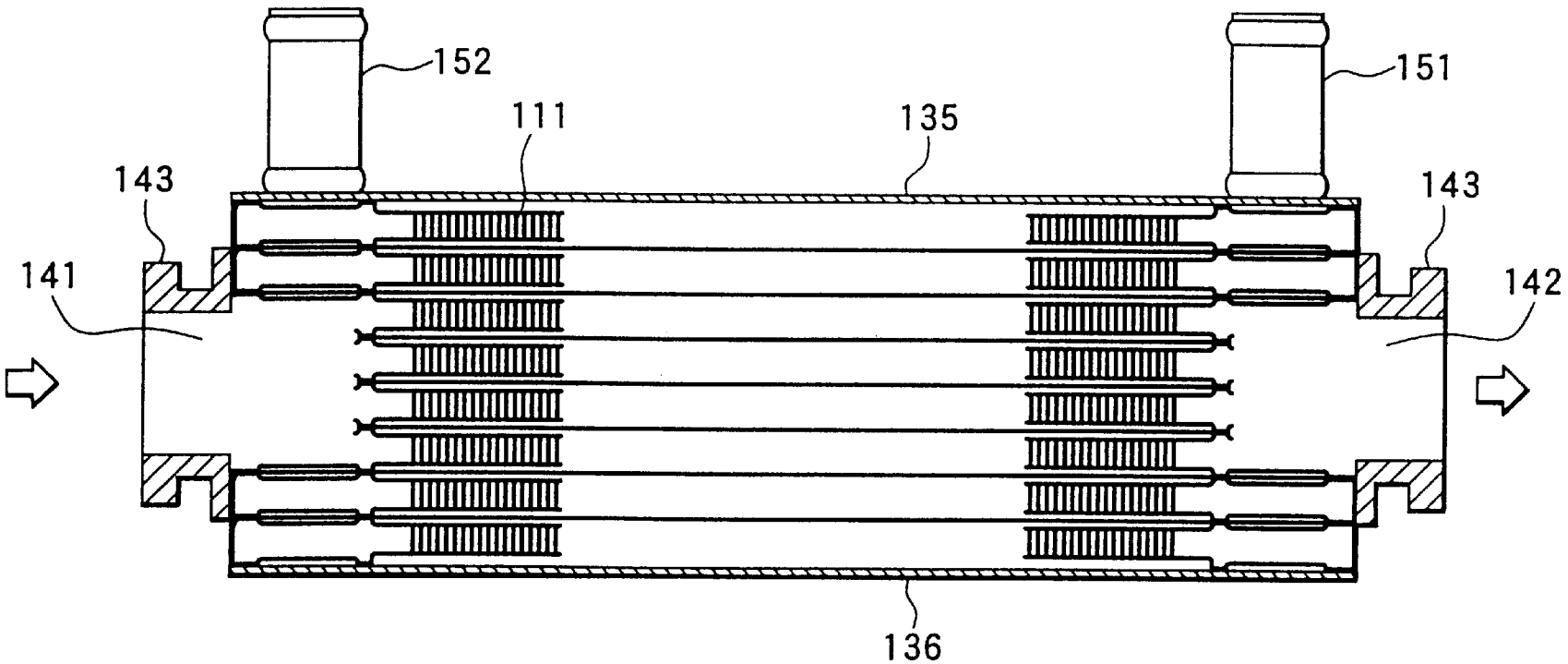
FIG. 4 is a cross-sectional view taken along line IV—IV in FIG. 3.
Figure 6:
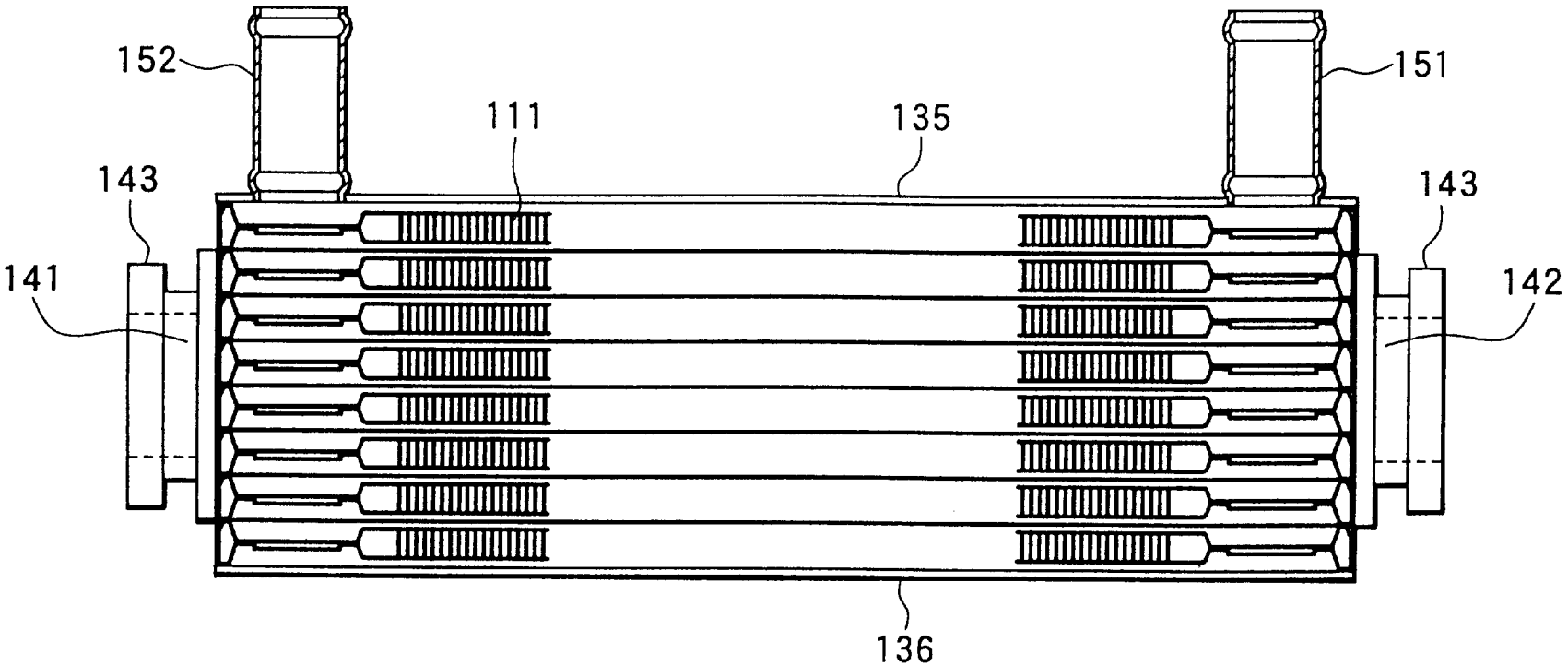
FIG. 6 is a cross-sectional view taken along line IV-C-D-E-F-G-H-IV in FIG. 3.

Each of the tubes 110, 120 is formed by connecting a pair of thin lamination plates 131, 132 having predetermined pressed shapes. After plural pairs of the lamination plates 131, 132 are laminated in a lamination direction (i.e., the up-down direction in FIG. 5), the lamination plates 131, 132 are brazed with the inner fins 111 using a predetermined brazing material. Therefore, as shown in FIGS. 4 and 6, the exhaust gas passages 110*a* and the cooling water passages 120*a* are formed to extend in a direction parallel to a plate longitudinal direction (i.e., right-left direction in FIGS. 4 and 6).

The lamination plates 131, 132 are obtained by press-forming approximate rectangular thin plates into predetermined shapes, respectively. A first protrusion wall 133 protruding toward one side in the laminating direction LD of the lamination plates 131, 132 is integrally formed with an end of the lamination plate 131, among the pair of the lamination plates 131, 132. A second protrusion wall 134 protruding toward the other side in the laminating direction LD is integrally formed with an end of the lamination plates 132, among the pair of the lamination plates 131, 132.

Both the protrusion walls 133, 134 are brazed to each other to be bonded on surfaces 133*a*, 134*a* thereof, parallel to the laminating direction LD. As shown in FIG. 4, the exhaust gas introduction port 141 for introducing exhaust gas into the exhaust gas passages 110*a* and the exhaust gas discharge port 142 for discharging exhaust gas from the exhaust gas passages 110*a* are formed in the protrusion walls 133, 134. Therefore, main-flow of exhaust gas passes through the exhaust gas tubes 110 approximately linearly from the one end toward the other end of the tube longitudinal direction of the exhaust gas tubes 110.

In the first embodiment, as shown in FIG. 5, both the protrusion walls 133, 134 define a tank portion 102 for accommodating a core portion 101 having the both passages 110*a*, 120*a*.

Figure 7B:
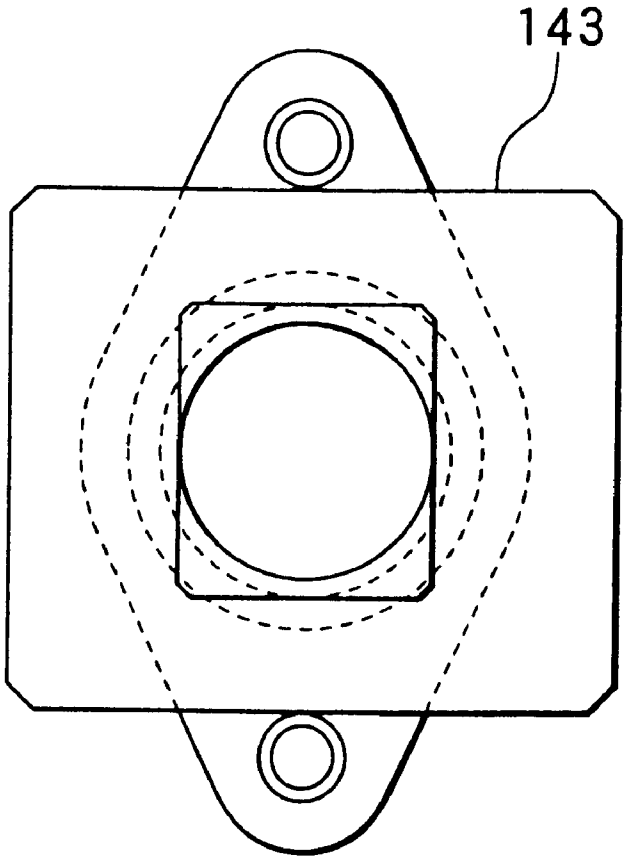
FIGS. 7A and 7B are a side view and a front view, respectively, showing a joint of the EGR cooler, according to the first embodiment.
Figure 7A:
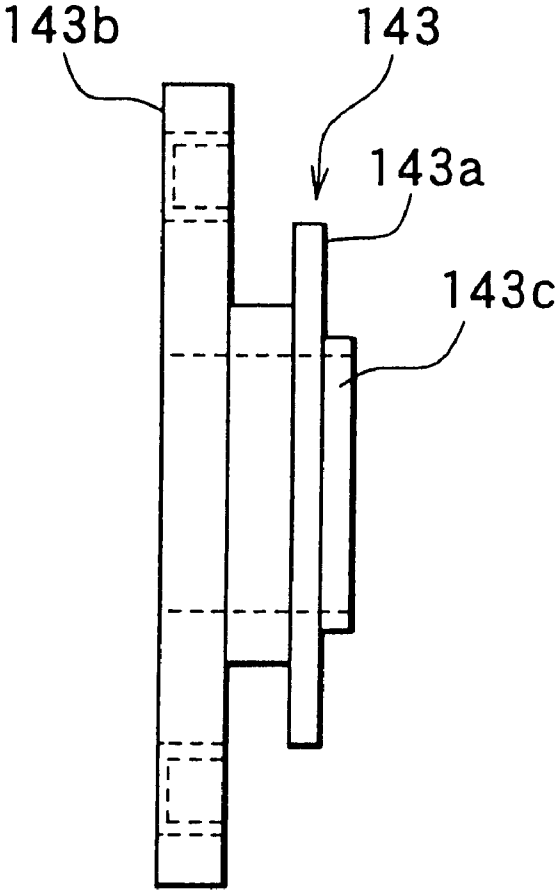

The joint 143 in which the exhaust gas introduction port 141 and the exhaust gas discharge port 142 are formed is connected to the exhaust gas recirculation pipe 210 (exterior pipe). As shown in FIGS. 7A, 7B, the joint 143 made of stainless includes a rectangular first flange portion 143*a* bonded to both the protrusion walls 133, 134 of the lamination plates 131, 132 through brazing, and a second flange portion 143*b* connected to the exhaust gas recirculation pipe 210 by using bolts. The second flange portion 143*b* has bold insertion holes, and is formed into an approximate diamond shape. On the first flange portion 143*a*, a protrusion portion 143*c* for setting the position of the joint 143 relative to the exhaust gas introduction port 141 and the exhaust gas discharge port 142 is formed.

Figure 8:
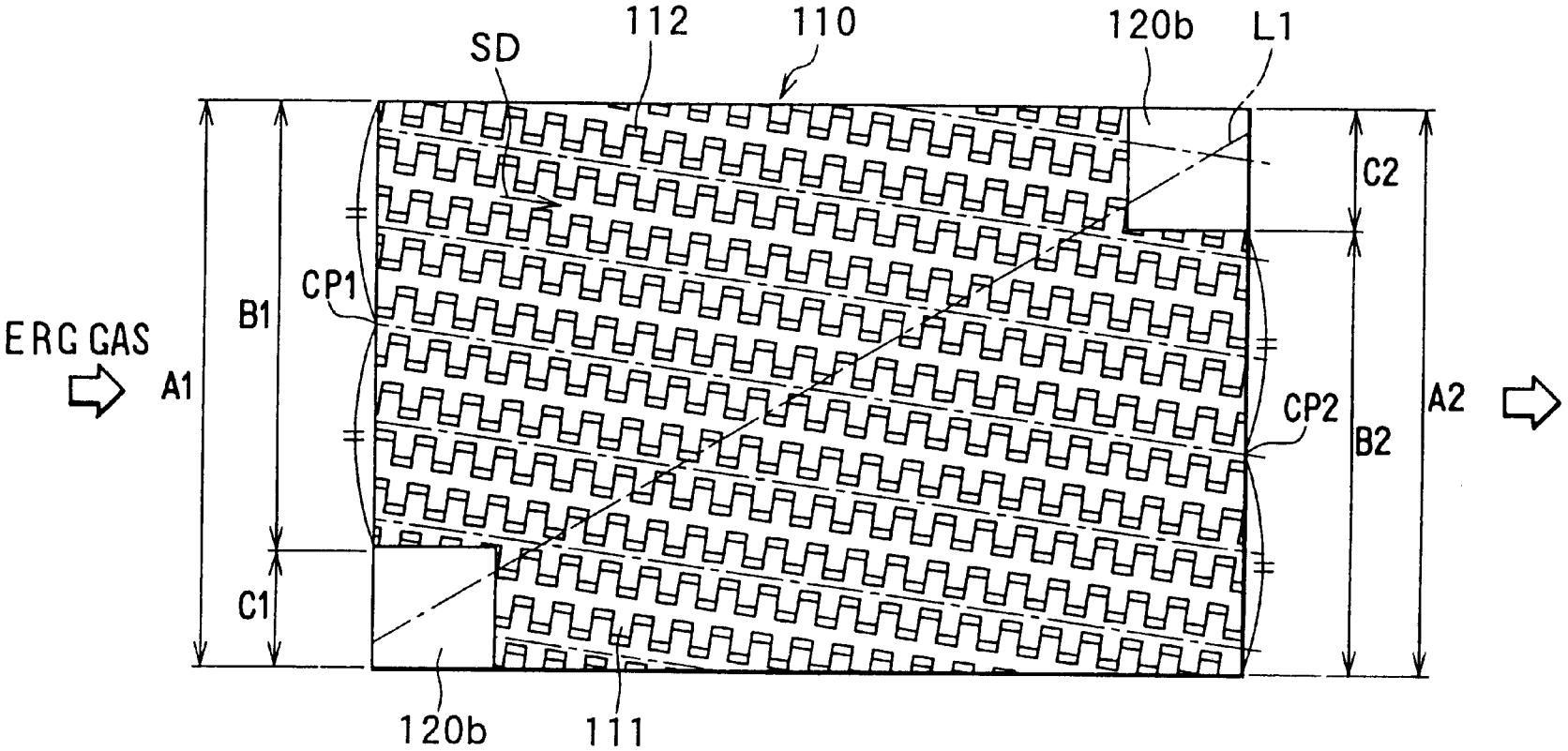
FIG. 8 is a schematic view showing a tilt direction of segments within an exhaust gas tube according to the first embodiment.
Figure 9:
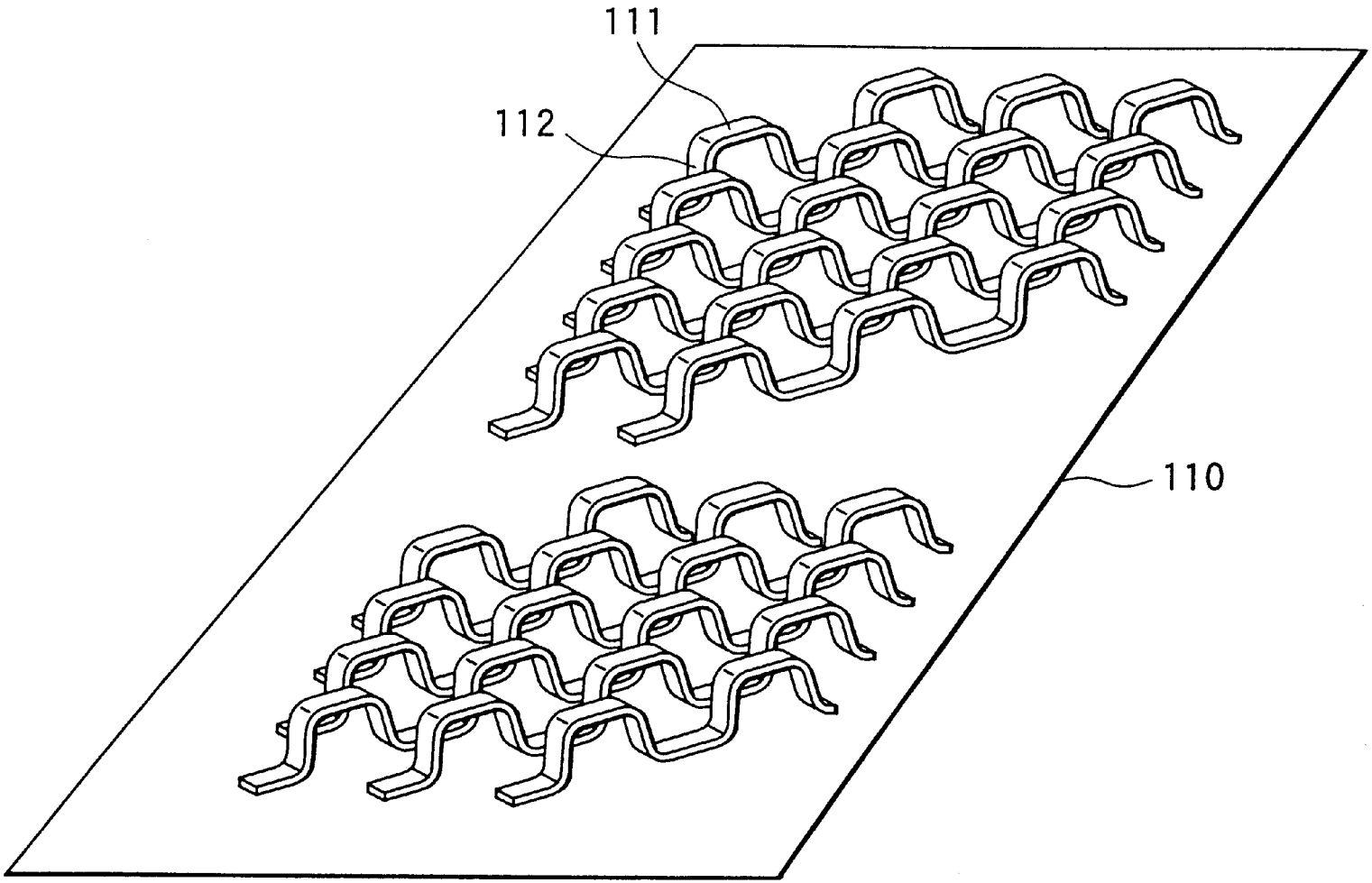
FIG. 9 is a perspective view showing segments of inner fins according to the first embodiment.

On the other hand, cooling water is introduced into the cooling water tubes 120 through the water inlet pipe 151, and cooling water having been heat-exchanged with exhaust gas is discharged from the cooling water tubes 120 through the water outlet pipe 152. As shown in FIG. 8, the cooling water passages 120*b* in each cooling water tubes 120 communicate with each other through cooling water communication passages (cooling water tank) 120*b* formed at both longitudinal end sides of the exhaust gas tubes 110. The cooling water communication passages 120*b* are formed at diagonal positions when being viewed from the minor-diameter direction of the exhaust gas tubes 110. Both the pipes 151, 152 are connected to approximately linearly communicate with the cooling water communication passages 120*b*.

In the first embodiment of the present invention, the cooling water inlet pipe 151 is provided at a side of the exhaust gas discharge port 142 and the cooling water outlet pipe 152 is provided at a side of the exhaust gas introduction port 141, so that a flow of cooling water in the cooling water passage 120*a* is opposite to a flow of exhaust gas in the exhaust gas passage 110*a*.

Next, the arrangement structure of the segments 112 of the inner fins 111 will be now described. In the first embodiment, as shown in FIG. 8, the segments 12 are tilted in a tilt direction SD (i.e., plate direction) relative to the longitudinal direction of the exhaust gas tubes 110 by a predetermined angle (e.g., 5–30°) toward a side opposite to a diagonal line L1 connecting both the cooling water communication passages 120*b*. As shown in FIG. 8, exhaust gas mainly flows in the exhaust gas tubes 110 along around a gas main flow line L2. The gas main flow line L2 is a connection line connecting a center point CP1 and a center point CP2 of exhaust gas flowing parts at both longitudinal ends of the exhaust gas tube 110. That is, the center point CP1 is a center of a part B1 which is obtained by subtracting a dimension C1 from a major-diameter dimension A1 of the exhaust gas tube 110, and the center point CP2 is a center of a part B2 which is obtained by subtracting a dimension C2 from a major-diameter dimension A2 of the exhaust gas tube 110. In the first embodiment, the segments 112 are tilted so that the tile direction SD of the segments 112 is approximately parallel to the gas main flow line L2.

Thus, a cross angle between a tilt line in the tilt direction SD of the segments 112 and the maim flow of the exhaust gas becomes smaller, and pressure loss of exhaust gas in the exhaust gas tube 110 can be reduced. Accordingly, an amount of exhaust gas flowing through the exhaust gas tubes 110 is increased, and heat-exchanging capacity of the EGR cooler 100 is increased. Further, because the tilt direction SD of the segments 112 is not completely parallel to the main flow of exhaust gas even while the cross angle between the tilt direction of the segments 112 and the main flow of exhaust gas becomes smaller, a gas flow of exhaust gas directly colliding with a plate surface of the segments 112 and a gas flow of exhaust gas crossing between the segments 112 on different tilt lines in the tilt direction are generated.

Dust adhered on the segments 112 can be separated due to the exhaust gas flow directly colliding with the plate surfaces of the segments 112, and dust staying at an immediately downstream side of the segments 112 forcibly flows toward a downstream side due to the exhaust gas flow crossing between the segments 12 on the different tilt lines on the tilt direction. As a result, it can prevent dust from being collected in the inner fines 111 within the exhaust gas tubes 110.

Exhaust gas generated by a combustion of the engine flows by only a pressure different between an exhaust gas inlet side and an exhaust gas outlet side in the EGR cooler 100 without using pump means. Therefore, when pressure loss within the exhaust gas tube 110 is large, a flow of exhaust gas becomes difficult, and the heat-exchanging capacity of the EGR cooler is reduced. However, according to the present invention, because the tilt direction SD of the segments 112 is approximately parallel to the gas main flow line L2, pressure loss, generated while exhaust gas flows through the exhaust gas tube 110, becomes smaller.

Figure 11A:
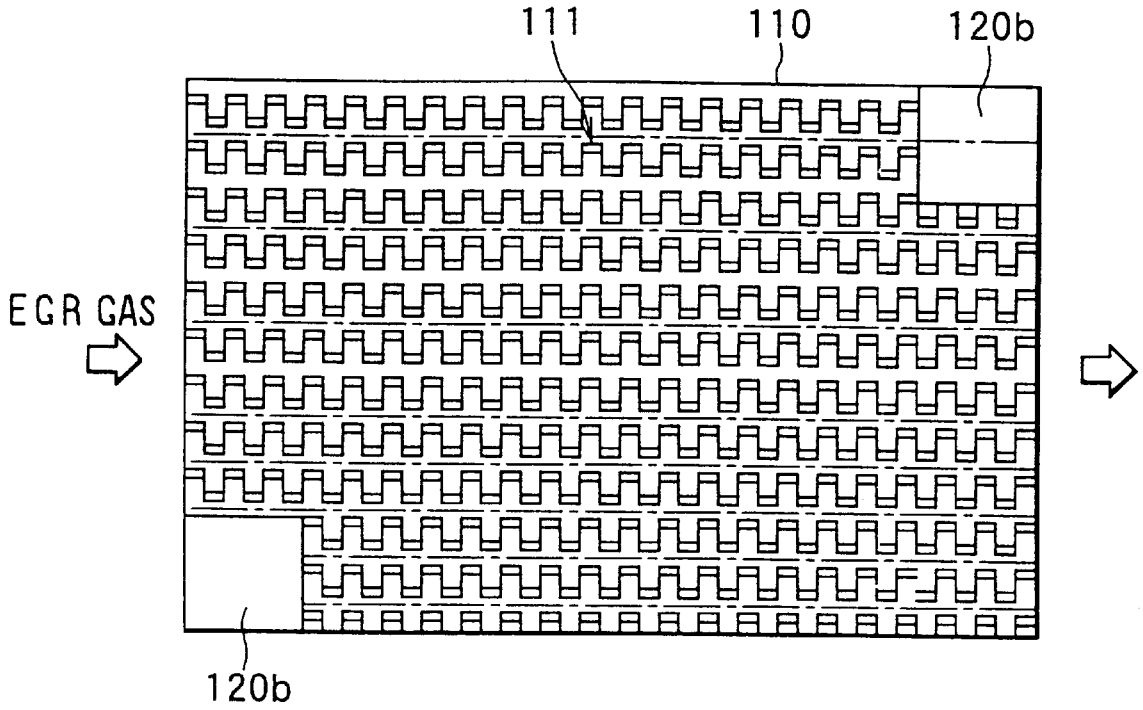
FIG. 11A is a schematic view showing segments within an exhaust gas tube according to a comparison example of the present invention.
Figure 11B:
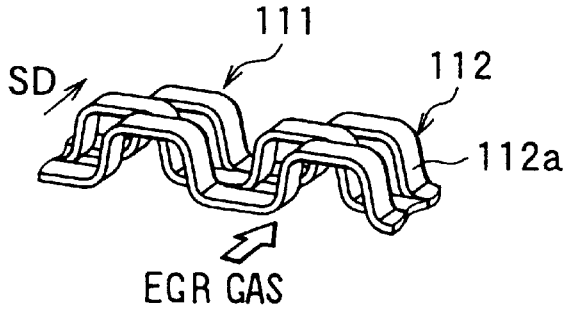
FIG. 11B is a perspective view of offset fins.

The inventors of the present invention experimentally product an EGR cooler in which offset fins 111 shown in FIG. 11B is disposed within an exhaust gas tube 110 as shown in FIG. 11A. In the comparison example shown in FIG. 11A, because the tilt direction of the segments 112 is parallel to the tube longitudinal direction of the exhaust gas tubes 110, dust such as carbon contained in the exhaust gas is readily adhered on the plate surfaces of the segments 112. Further, in the comparison example, because the tilt direction SD of the segments 112 is crossed with the gas main flow line L2 by a large cross-angle, the pressure loss of exhaust gas becomes larger in each exhaust gas tube 110.

Figure 10:
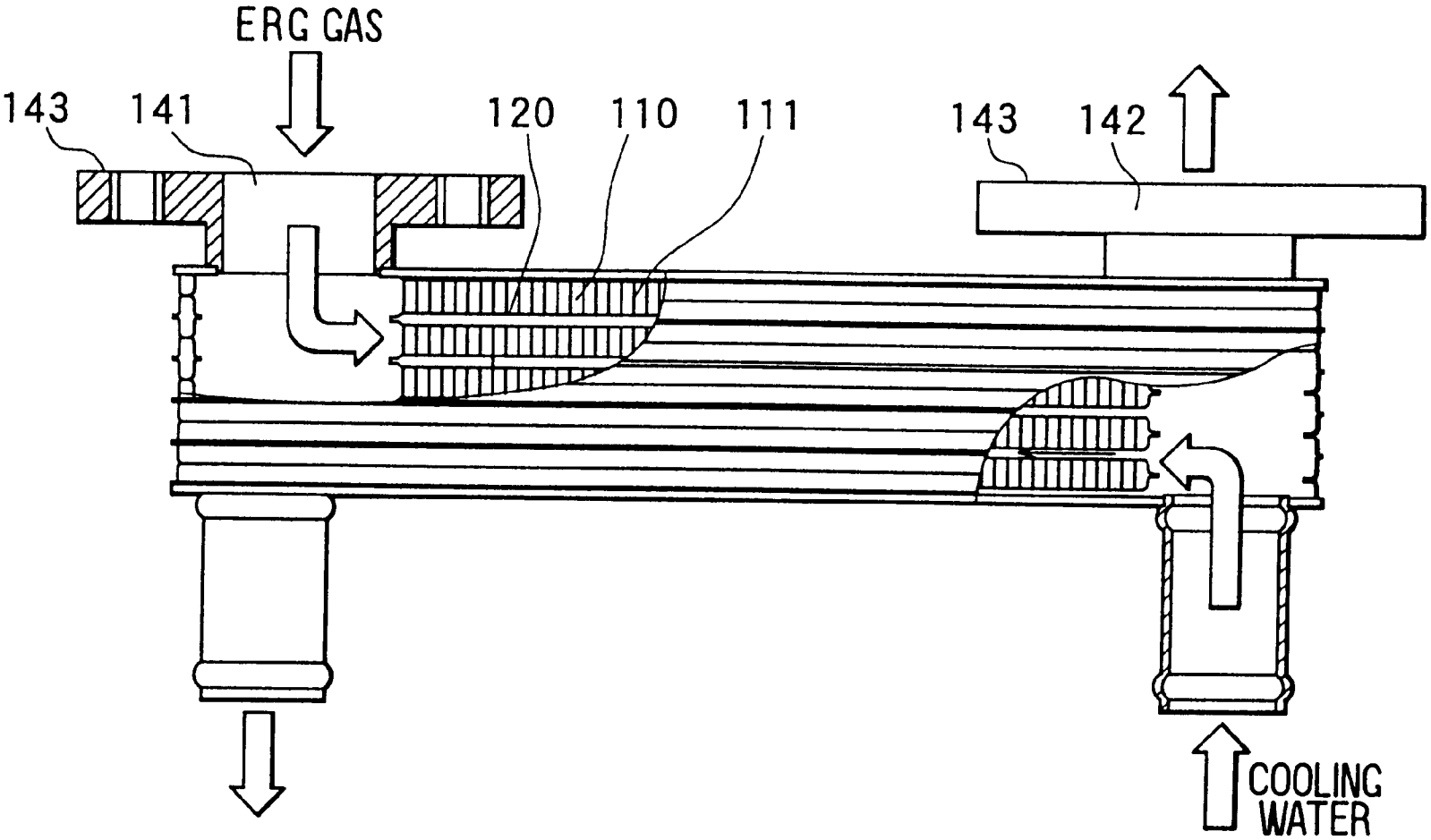
FIG. 10 is a front view of an EGR cooler according to a modification of the first embodiment.

In the above-described first embodiment of the present invention, the exhaust gas introduction port 141 and the exhaust gas discharge port 142 are opened toward the longitudinal direction of the exhaust gas tubes 110, as shown in FIGS. 4 and 6. However, the exhaust gas introduction port 141 and the exhaust gas discharge port 142 may be opened toward a direction perpendicular to the longitudinal direction of the exhaust gas tubes 110, as shown in FIG. 10. Even in this case, the same effect as the first embodiment is obtained.

Figure 12:
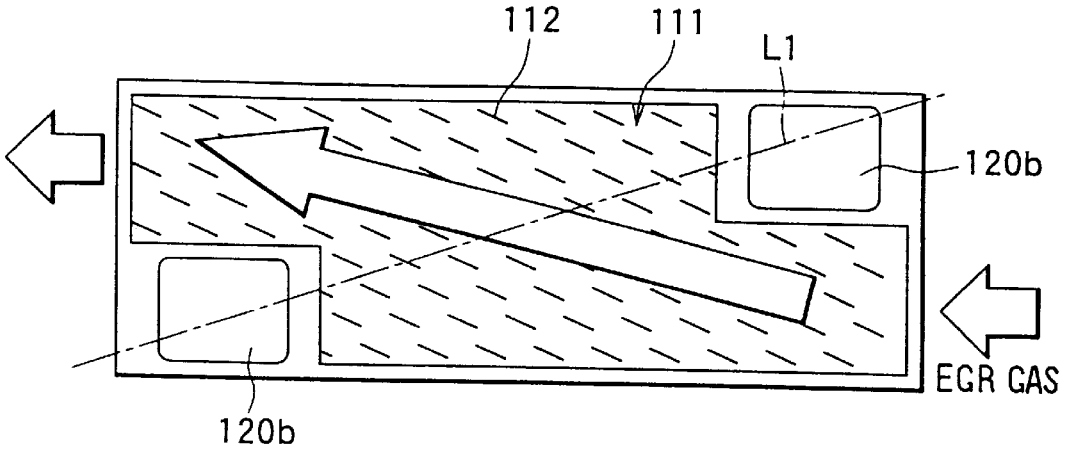
FIG. 12 is a schematic view of an exhaust gas tube according to a second preferred embodiment of the present invention.
Figure 13:
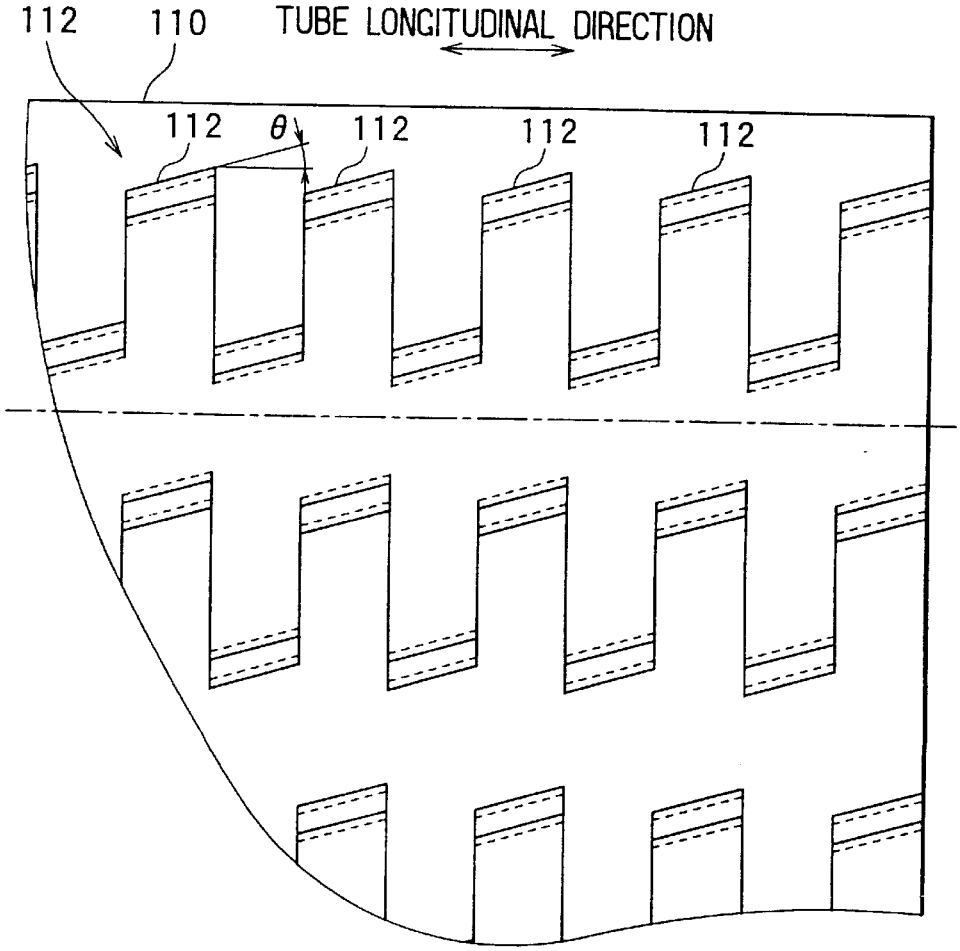
FIG. 13 is a front view of inner fins according to the second embodiment.

A second preferred embodiment of the present invention will be now described with reference to FIGS. 12–17. Here, the specific shapes of the segments 112 of the inner fins 111 are mainly described in detail. In the second embodiment, the other parts are similar to those of the above-described first embodiment, and the explanation thereof is omitted. FIG. 12 is a schematic view of an exhaust gas tube, showing an arrangement of the segments 112 (fin 111) according to the second embodiment. FIG. 13 is a front view showing the segments 112 of the second embodiment when being viewed from the minor-diameter direction of the exhaust gas tube 111, and FIG. 14 is a schematic view of the fin 111 only showing the segments 112 in which a tilt relative to the tube minor-diameter direction due to draft is not considered.

Figure 14:
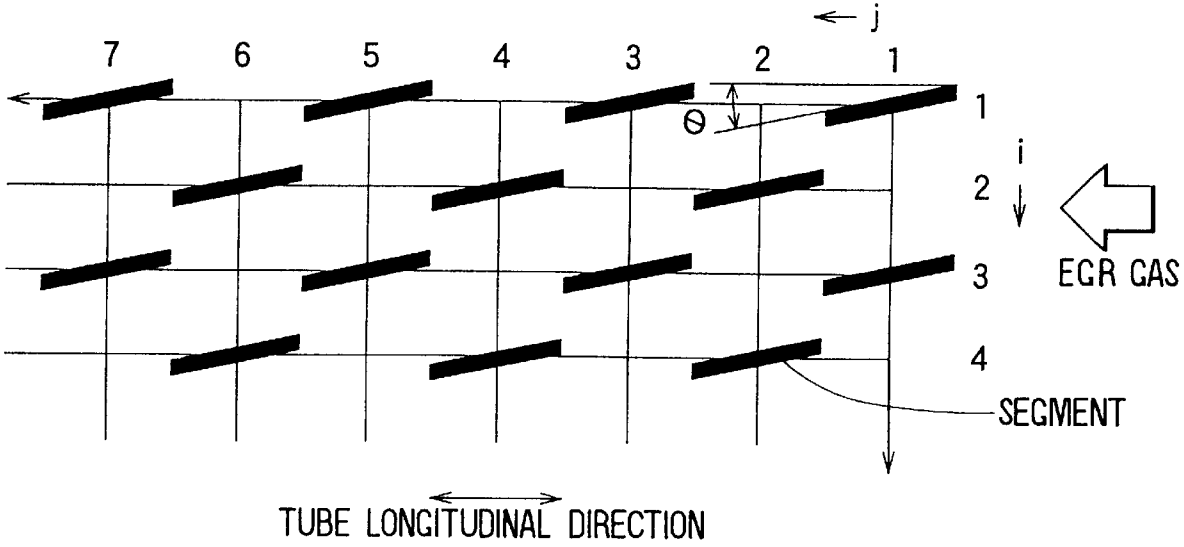
FIG. 14 is a schematic view showing a tile arrangement of segments according to the second embodiment.

In the second embodiment, as shown in FIG. 12–14, the tilt direction of the segments 112 relative to the longitudinal direction of the exhaust gas tube 110 is set to be tilted by a predetermined angle θ opposite to the diagonal line L1 connecting both the cooling water communication passages 120*b*, similarly to the first embodiment. In the second embodiment, the predetermined angle θ is set to be equal to or lower than 45°. In the second embodiment, the arrangement of the segments 112 from one end to the other end in the major-diameter direction (the up-down direction in FIG. 14) of the exhaust gas tube 110 is indicated as a row "j", and the arrangement of the segments 112 from one end to the other end in the longitudinal direction (right-left direction in FIG. 14) of the exhaust gas tube 110 is indicated as a line "i". In this case, a segment 112 positioned at i-line and j-row is tilted toward a center of any one segment 112 except for the i-line segments 112, j-row segments and (i+n)-line and (j+n)-row positioned segments 112. Here, "i", "j" and "n" are the whole number.

Specifically, when the segment positioned at i-line and j-row is indicated as segment (i,j), the segment (1,1) is tilted toward a center of any one segments (2,4), (2,6), (3,5), (3,7), (4,2), (4,6), except for the first row segment (3,1), the first line segments (1,3), (1,5), (1,7) and the (i+n)-line and (j+n)-row positioned segments (2,2), (3,3), (4,4). In the second embodiment, the segment (1,1) is tilted toward the center of the segment (2,4), as shown in FIG. 14. Therefore, as shown in FIG. 15, a distance between an upstream segment 112 and a downstream segment 112, positioned on the same tilt line in the tilt direction, becomes larger as compared with a comparison example where the segments are simply offset as shown in FIG. 17.

Figure 15:
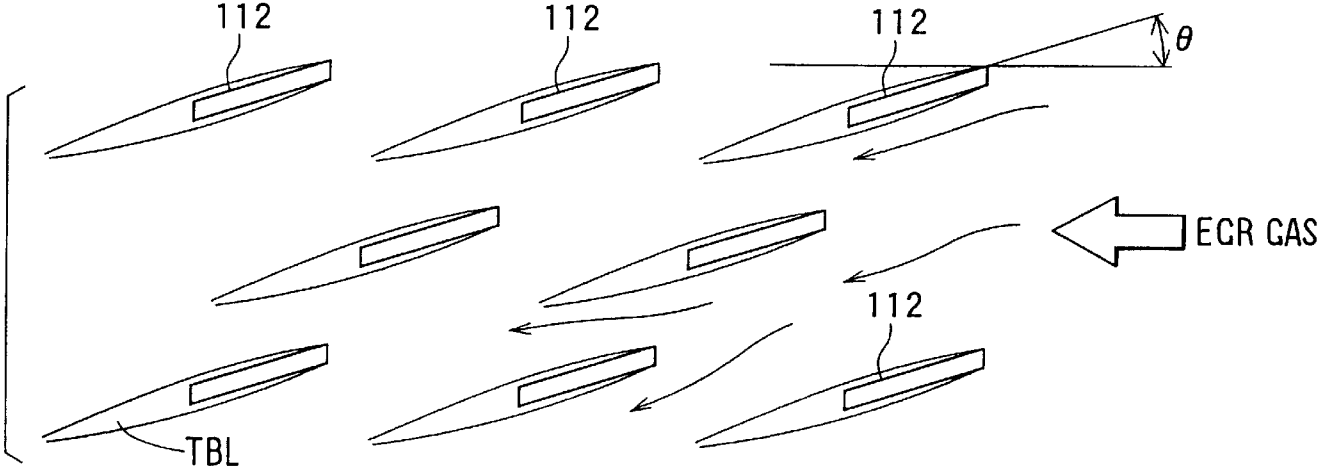
FIG. 15 is a view for explaining a flow of exhaust gas between the segments, and a temperature boundary layer (TBL), according to the second embodiment.

Thus, in the second embodiment, as shown in FIG. 15, a temperature boundary layer (TBL) generated at a front periphery of a segment 112 does not extend to a downstream segment 112 on the same tilt line. That is, it can prevent the temperature boundary layer (TBL) from being generated over an entire area of the exhaust gas tube 110 in the tube longitudinal direction. Accordingly, heat-transmitting percentage between the fins 111 and exhaust gas can be improved, and the heat-exchanging effect of the EGR cooler 100 is further improved.

Further, because the segments 112 are tilted relative to the tube longitudinal direction toward a side opposite to diagonal line L1 connecting both the cooling water connection passages 120*b*, the cross angle between the tilt direction of the segments 112 and the exhaust gas main flow is made smaller, similarly to the above-described first embodiment. Therefore, pressure loss in the exhaust gas tube 110 can be reduced.

Figure 16:
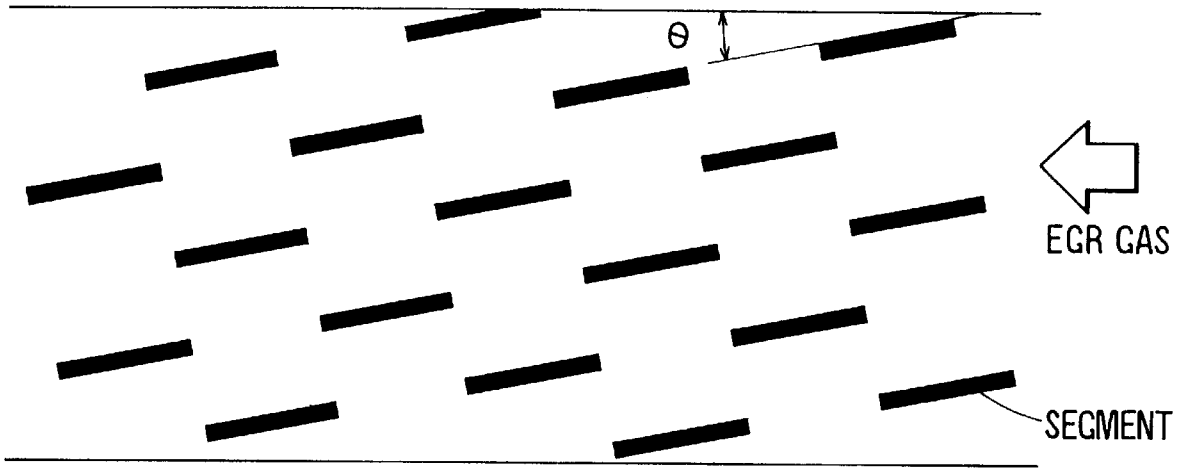
FIG. 16 is a schematic view showing a tile arrangement of segments according to a comparison example of the second embodiment.
Figure 17:
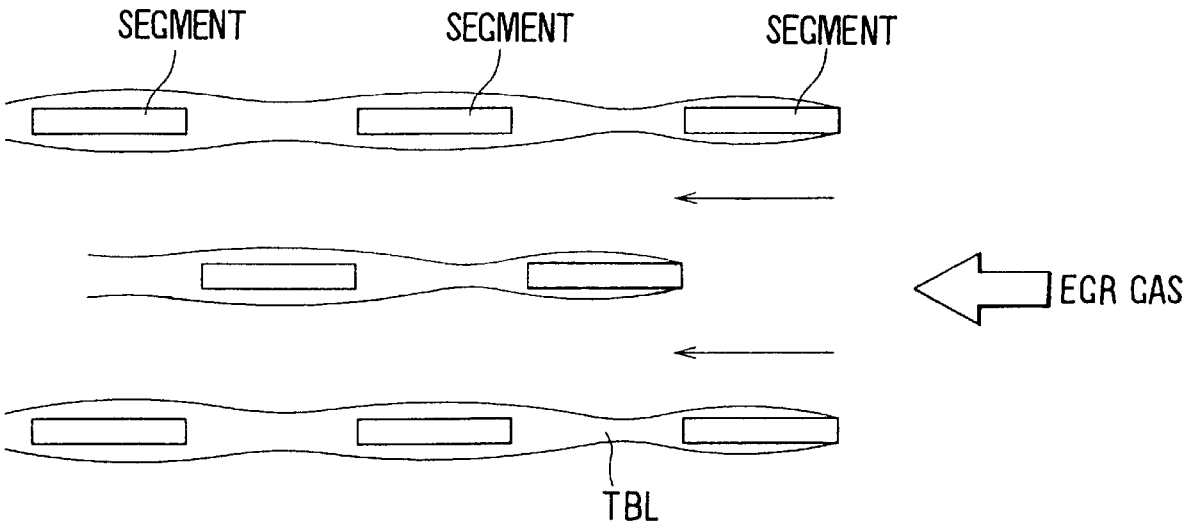
FIG. 17 is a schematic view showing an arrangement of segments according to an another comparison example of the second embodiment.

When the offset fin shown in FIG. 17 is simply tilted relative to the longitudinal direction of the exhaust gas tube 110 as shown in FIG. 16, a distance between adjacent segments 112 on the same tilt line in the tilt direction of the exhaust gas tube 110 becomes smaller, and the temperature boundary layer may be generated over the entire area of the exhaust gas tube 110. Therefore, the heat-transmitting percentage between the fins 111 and the exhaust gas may be deteriorated. If the number of the segments 112 is simply reduced for increasing the distance between adjacent segments on the same tilt line in the tilt direction in FIG. 16, an entire heat-transmitting area of the fins 111 is reduced, and the heat-exchanging capacity of the EGR cooler is reduced.

According to the second embodiment of the present invention, relative to the simple offset fins shown in FIG. 17, the segments 112 are tilted from the arrangement shown in FIG. 17 while the positions of the segments 112 are not changed. Therefore, the entire heat-conducting area of the fins 111 is not restricted. Accordingly, in the second embodiment, the heat-exchanging capacity of the EGR cooler 100 is improved, while the pressure loss and the dust-collecting within the exhaust gas tube 110 are prevented.

In the second embodiment of the present invention, the i-line and j-row positioned segment 112 is tilted toward a center of any one segment 112 except for the i-line segments 112, j-row segments and (i+n)-line and (j+n)-row positioned segments 112, while being tilted relative to the tube longitudinal direction toward a side opposite to the diagonal line L1. However, when segments 112 are disposed so that the i-line and j-row positioned segment 112 is tilted toward a center of any one segment 112 except for the i-line segments 112, j-row segments and (i+n)-line and (j+n)-row positioned segments 112, the segments 112 may be tilted relative to the tube longitudinal direction toward a side of the diagonal line L1. Even in this case, because one segment 112 is tilted toward an another segment 112 which is separated from the one segment 112 by three rows or rows more than three rows, a distance between an upstream segment 112 and a downstream segment 112 on the same tilt line in the tilt direction becomes larger as compared with the comparison example shown in FIG. 17. Therefore, heat-transmitting percentage of the inner fins 111 with exhaust gas can be increased. That is, in the second embodiment of the present invention, the tilt direction of the segment 112 relative to the tube longitudinal direction may be arbitrarily set.

Further, the tilt of the segments 112 can be set as described later. That is, the segments 112 can be disposed in such a manner that one segment 112 is separated from an another segment 112 on the same tilt line in the tilt direction by two rows or rows more than two rows. Similarly to the above-described second embodiment, a distance between adjacent segments 112 on the same tilt line in the tilt direction becomes larger. Even in this case, the tilt direction of the segment 112 relative to the tube longitudinal direction may be arbitrarily set.

Although the present invention has been fully described in connection with the preferred embodiments thereof with reference to the accompanying drawings, it is to be noted that various changes and modifications will become apparent to those skilled in the art.

For example, the present invention described in the first and second embodiments may be applied to a heat exchanger, disposed within a silencer, for recovering heat energy from exhaust gas, and may be applied to a heat exchanger for the other use.

Such changes and modifications are to be understood as being within the scope of the present invention as defined by the appended claims.

What is claimed is:

1. A heat exchanger comprising:

an exhaust gas tube through which exhaust gas generated by a combustion flows, said exhaust gas tube having a flat sectional shape;

a plurality of cooling fluid tubes through which cooling fluid for cooling exhaust gas flows, said cooling fluid tubes being disposed adjacent to both ends of said exhaust gas tube in a minor-diameter direction of said exhaust gas tube; and an offset fin disposed within said exhaust gas tube, said offset fin having a plurality of plate-like segments which are approximately parallel to said minor-diameter direction and are arranged in a longitudinal direction of said exhaust gas tube in such a manner that adjacent segments in the longitudinal direction are offset from each other in a major-diameter direction of said exhaust gas tube, wherein said segments are disposed to be tilted in a tilt direction relative to said longitudinal direction.

2. The heat exchanger according to claim 1, further comprising:

a cooling fluid tank for defining both cooling fluid communication passages through which said cooling fluid tubes communicate with each other, said cooling fluid communication passages being disposed on both end sides of said exhaust gas tube in said longitudinal direction at diagonal positions when being viewed from said minor-diameter direction, wherein said segments are disposed to be tilted relative to said longitudinal direction toward a side opposite to a diagonal line (L1) connecting said cooling fluid communication passages.

3. The heat exchanger according to claim 2, wherein said tilt direction of said segments is approximately parallel to a main flow line (L2) connecting a center point of one side end of said exhaust gas tube in said longitudinal direction and a center point of the other side end thereof, said one side end and the other side end of said exhaust gas tube in said longitudinal direction being exhaust gas flowing ends through which exhaust gas is introduced into and is discharged from said exhaust gas tube.

4. The heat exchanger according to claim 1, wherein:

when an arrangement of said segments from one end to the other end of said exhaust gas tube in a major-diameter direction is indicated as a row, and when an arrangement of said segments from one end to the other end of said exhaust gas tube in said longitudinal direction is indicated as a line, a segment positioned at i-line and j-row is tilted toward any one segment except for i-line segments, j-row segments and (i+n)-line and (j+n)-row positioned segments.

5. The heat exchanger according to claim 1, wherein:

when an arrangement of said segments from one end to the other end of said exhaust gas tube in a major-diameter direction is indicated as a row, a segment is separated from an another segment on the same tilt line in the tilt direction by two rows or rows more than two rows.

6. The heat exchanger according to claim 1, wherein said exhaust gas tube and said cooling fluid tubes are formed by laminating plural pairs of thin plates in a plate thickness direction, each pair of said thin plates having predetermined pressed shapes.

7. The heat exchanger according to claim 1, wherein:

exhaust gas from an internal combustion engine flows into said exhaust gas tube, and the exhaust gas having been heat-exchanged with cooling fluid flowing through said cooling fluid tubes returns to an intake side of said internal combustion engine.

8. The heat exchanger according to claim 2, wherein:

said segments are tilted relative to said longitudinal direction by a predetermined tilt angle; and said predetermined tilt angle is in a range of 5–30°.

9. The heat exchanger according to claim 2, wherein:

when an arrangement of said segments from one end to the other end of said exhaust gas tube in a major-diameter direction is indicated as a row, and when an arrangement of said segments from one end to the other end of said exhaust gas tube in said longitudinal direction is indicated as a line, a segment positioned at i-line and j-row is tilted toward any one segment except for i-line segments, j-row segments and (i+n)-line and (j+n)-row positioned segments.

10. The heat exchanger according to claim 2, wherein:

when an arrangement of said segments from one end to the other end of said exhaust gas tube in a major-diameter direction is indicated as a row, a segment is separated from an another segment on the same tilt line in the tilt direction by two rows or rows more than two rows.

* * * * *